US008357881B2

(12) United States Patent
Feng et al.

(10) Patent No.: US 8,357,881 B2
(45) Date of Patent: Jan. 22, 2013

(54) CARBON NANOTUBE FABRIC AND HEATER ADOPTING THE SAME

(75) Inventors: Chen Feng, Beijing (CN); Kai-Li Jiang, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 441 days.

(21) Appl. No.: 12/592,257

(22) Filed: Nov. 19, 2009

(65) Prior Publication Data

US 2011/0036828 A1 Feb. 17, 2011

(30) Foreign Application Priority Data

Aug. 14, 2009 (CN) ..... 2009 1 0109333

(51) Int. Cl.
*H05B 3/34* (2006.01)
*H05B 3/54* (2006.01)

(52) U.S. Cl. ..... 219/529

(58) Field of Classification Search ..... 219/529
See application file for complete search history.

(56) References Cited

U.S. PATENT DOCUMENTS

| | | | |
|---|---|---|---|
| 5,698,175 | A | 12/1997 | Hiura et al. |
| 5,958,358 | A | 9/1999 | Tenne et al. |
| 6,863,942 | B2 | 3/2005 | Ren et al. |
| 7,045,108 | B2 | 5/2006 | Jiang et al. |
| 7,077,939 | B1 | 7/2006 | Crooks et al. |
| 7,166,266 | B2 | 1/2007 | Nikolaev et al. |
| 7,355,216 | B2 | 4/2008 | Yang et al. |
| 7,569,850 | B2 | 8/2009 | Noy et al. |
| 7,750,297 | B1 | 7/2010 | Chow et al. |
| 2003/0185741 | A1 | 10/2003 | Matyjaszewski et al. |
| 2004/0034177 | A1 | 2/2004 | Chen |
| 2004/0053780 | A1 | 3/2004 | Jiang et al. |
| 2004/0144970 | A1 | 7/2004 | Wang et al. |
| 2005/0007002 | A1 | 1/2005 | Golovchenko et al. |
| 2005/0208304 | A1 | 9/2005 | Collier et al. |
| 2006/0169975 | A1 | 8/2006 | Noy et al. |
| 2006/0204428 | A1 | 9/2006 | Noy et al. |
| 2006/0275956 | A1 | 12/2006 | Konesky |
| 2007/0128707 | A1 | 6/2007 | Rorrer et al. |
| 2007/0137786 | A1 | 6/2007 | Luzzi |
| 2007/0142559 | A1 | 6/2007 | Wang et al. |
| 2007/0166223 | A1 | 7/2007 | Jiang et al. |

(Continued)

FOREIGN PATENT DOCUMENTS

| | | |
|---|---|---|
| CN | 1066934 | 12/1992 |
| CN | 2277273 Y | 4/1998 |

(Continued)

OTHER PUBLICATIONS

Zhu et al., Aligned Carbon Nanotube Stacks by Water-Assisted Selective Etching, Nano Letters, (2005), pp. 2641-2645.

(Continued)

*Primary Examiner* — William D Coleman
(74) *Attorney, Agent, or Firm* — Altis Law Group, Inc.

(57) ABSTRACT

A carbon nanotube fabric includes a heating element and at least two electrodes. The heating element includes a plurality of carbon nanotubes joined end to end. The at least two electrodes are separately located and electrically connected to the carbon nanotubes of the heating element.

19 Claims, 14 Drawing Sheets

U.S. PATENT DOCUMENTS

| | | | | |
|---|---|---|---|---|
| 2007/0295714 | A1 | 12/2007 | Liu et al. | |
| 2008/0083720 | A1* | 4/2008 | Gentile et al. | 219/211 |
| 2008/0170982 | A1* | 7/2008 | Zhang et al. | 423/447.3 |
| 2008/0187648 | A1 | 8/2008 | Hart et al. | |
| 2008/0237464 | A1 | 10/2008 | Zhang et al. | |
| 2008/0251274 | A1 | 10/2008 | Lee et al. | |
| 2008/0290080 | A1* | 11/2008 | Weiss | 219/202 |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2010/0203316 | A1 | 8/2010 | Hata et al. | |

FOREIGN PATENT DOCUMENTS

| | | | |
|---|---|---|---|
| CN | 2419303 | Y | 2/2001 |
| CN | 2462823 | | 12/2001 |
| CN | 1549654 | A | 11/2004 |
| CN | 2696260 | Y | 4/2005 |
| CN | 1731897 | | 2/2006 |
| CN | 2768365 | | 3/2006 |
| CN | 101014218 | | 8/2007 |
| CN | 101090586 | | 12/2007 |
| CN | 101212848 | | 7/2008 |
| CN | 101217097 | | 7/2008 |
| CN | 101276724 | | 10/2008 |
| CN | 101400198 | | 4/2009 |
| CN | 101409961 | | 4/2009 |
| CN | 101409962 | | 4/2009 |
| JP | 8-87 | | 1/1996 |
| JP | 2000-195470 | | 7/2000 |
| JP | 2003-130376 | | 5/2003 |
| JP | 2005249414 | | 9/2005 |
| JP | 2006-147286 | | 6/2006 |
| JP | 2006244742 | | 9/2006 |
| JP | 2008523254 | | 7/2008 |
| JP | 2008-198407 | | 8/2008 |
| JP | 2009-91239 | | 4/2009 |
| JP | 2009-94074 | | 4/2009 |
| TW | 391482 | | 5/2000 |
| TW | 200800793 | | 1/2008 |
| TW | M326535 | | 2/2008 |
| TW | M334291 | | 6/2008 |
| TW | I341878 | | 7/2009 |
| WO | WO2008118486 | | 10/2008 |
| WO | WO2008133299 | | 11/2008 |

OTHER PUBLICATIONS

Zhang et al., "Formation of metal nanowires on suspended single-walled carbon nanotubes", Applied physics letters vol. 77, No. 19. Nov. 2000.

Klie et al. Multi-walled carbon nanotubes on amorphous carbon films, Carbon 42 (2004), pp. 1953-1957.

Xuesong et al., Bottom-up Growth of Carbon Nanotube Multilayers: Unprecedented Grow, Nano Letters (2005), pp. 1997-2000.

Zhang et al., "Metal coating on suspended carbon nanotubes and its implication to metal-tube interaction," Chemical physics letters 331 (2000), pp. 35-41.

Zhu et al., The growth of carbon nanotube stacks in the kinetics controlled regime, Science Direct, (2006) pp. 344-348.

Jiang Kai-Li et al. "Continuous carbon nanotube yarns and their applications" Physics, Aug. 2003, vol. 32, No. 8, p. 506-510, Section 2, the second paragraph of Section 4, Figure 1f and Figure 3a may be relevant.

* cited by examiner

CARBON NANOTUBE FABRIC AND HEATER ADOPTING THE SAME

CROSS-REFERENCE TO RELATED APPLICATIONS

This application claims all benefits accruing under 35 U.S.C. §119 from China Patent Application No. 200910109333.7, filed on Aug. 14, 2009 in the China Intellectual Property Office.

BACKGROUND

1. Technical Field

The present disclosure relates to a fabric and a heater adopting the same for heating.

2. Discussion of Related Art

Conventional fabric for heating includes a heating element and at least two electrodes. The at least two electrodes are located on a surface of the heating element, and electrically connected to the heating element. The heating element generates heat when a voltage is applied thereto.

The heating element can be made of metals, such as tungsten or carbon fibers. Metals, which have good conductivity, can generate a lot of heat even when a low voltage is applied. However, metals may easily oxidize, thus the heating element has a short life. Furthermore, metals have a relatively high density, and so metal heating elements are heavy, which limits applications of such a heater. Additionally, metal heating elements are difficult to bend to desired shapes without potentially breaking. Carbon fiber paper has a low heating efficiency and intensity, thereby affecting the durability thereof.

What is needed, therefore, is a carbon nanotube fabric and a heater adopting the same in which the above problems are eliminated or at least alleviated.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

Figure 1:
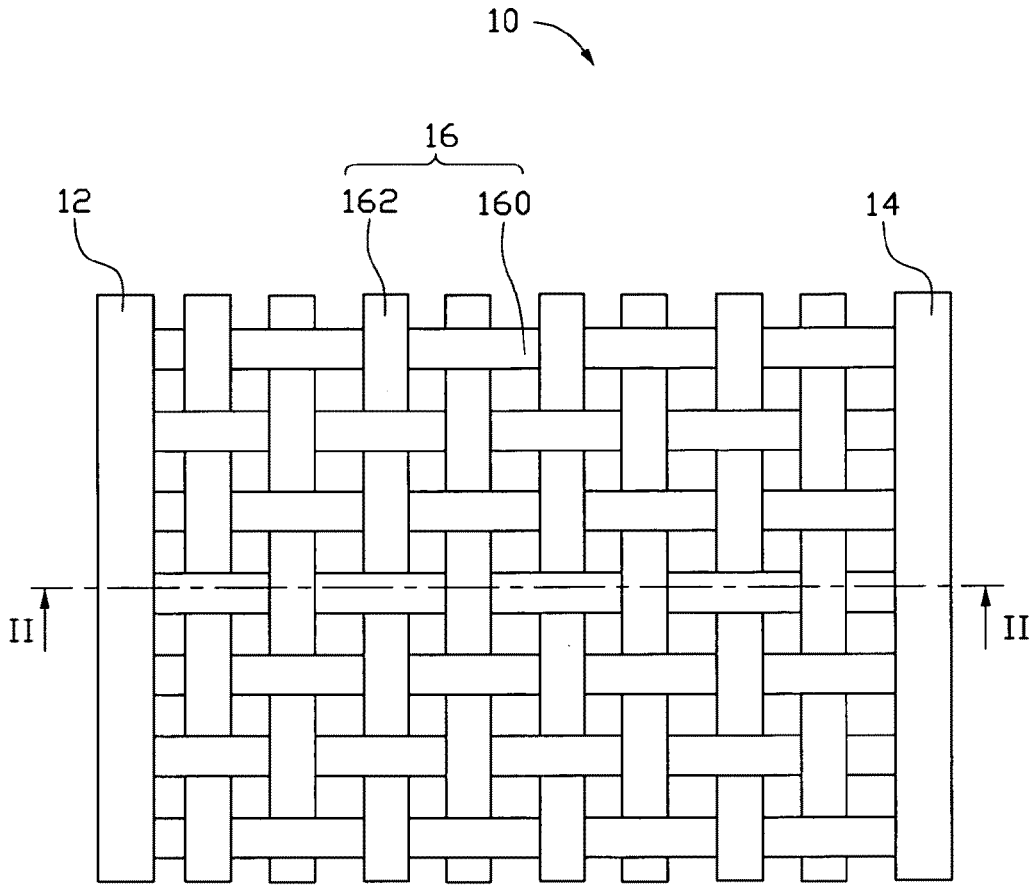
FIG. 1 is a schematic view of one embodiment of a carbon nanotube fabric.

Corresponding reference characters indicate corresponding parts throughout the several views. The examples set out herein illustrate at least one embodiment of the present carbon nanotube fabric and a heater adopting the same, in at least one form, and such examples are not to be construed as limiting the scope of the disclosure in any manner.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, embodiments of the present carbon nanotube fabric and a heater adopting the same.

Figure 2:
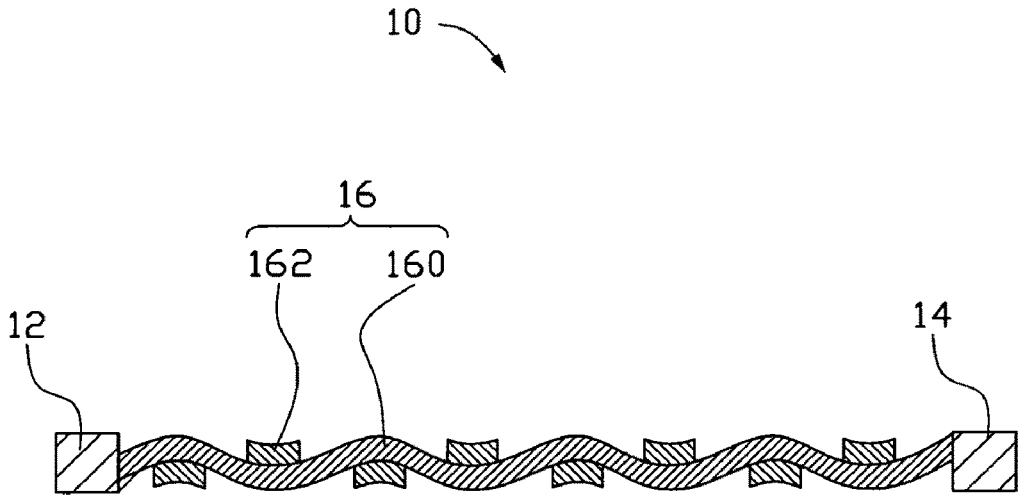
FIG. 2 is a schematic view of the carbon nanotube fabric of FIG. 1 along a line II-II.

Referring to FIGS. 1-2, a carbon nanotube fabric 10 according to one embodiment includes a heating element 16, a first electrode 12, and a second electrode 14. The first electrode 12 and the second electrode 14 are separately located, and electrically connected to the heating element 16. The heating element 16 includes at least one carbon nanotube wire-shaped structure 160 and at least one thread 162. The first electrode 12 and the second electrode 14 are electrically connected to the carbon nanotube wire-shaped structure 160. The heating element 16 can be formed by weaving the at least one carbon nanotube wire-shaped structure 160 and the at least one thread 162 together using known weaving techniques, such as plain weave, twill weave, or satin weave.

The carbon nanotube wire-shaped structure 160 can be arranged uniformly in the heating element 16. A distance between adjacent carbon nanotube wire-shaped structures 160 and threads 162 can be in a range from about 0 micrometers to about 30 micrometers. In one embodiment, the distance between adjacent two carbon nanotube wire-shaped structures 160 are equal, thereby a uniform heating can be acquired.

The carbon nanotube wire-shaped structure 160 can be located regionally in the heating element 16 according to needs. For example, when the carbon nanotube fabric 10 is applied to an infrared physiotherapy instrument, the carbon nanotube wire-shaped structure 160 can be located at a portion of the infrared physiotherapy instrument corresponding to the area needing physical therapy. Furthermore, the density of the carbon nanotube wire-shaped structure 160 in the carbon nanotube fabric 10 can be regulated, thereby regulating the resistance of the carbon nanotube fabric 10 in the area the carbon nanotube wire-shaped structure 160 is located, and realizing regional temperature control.

Figure 3:
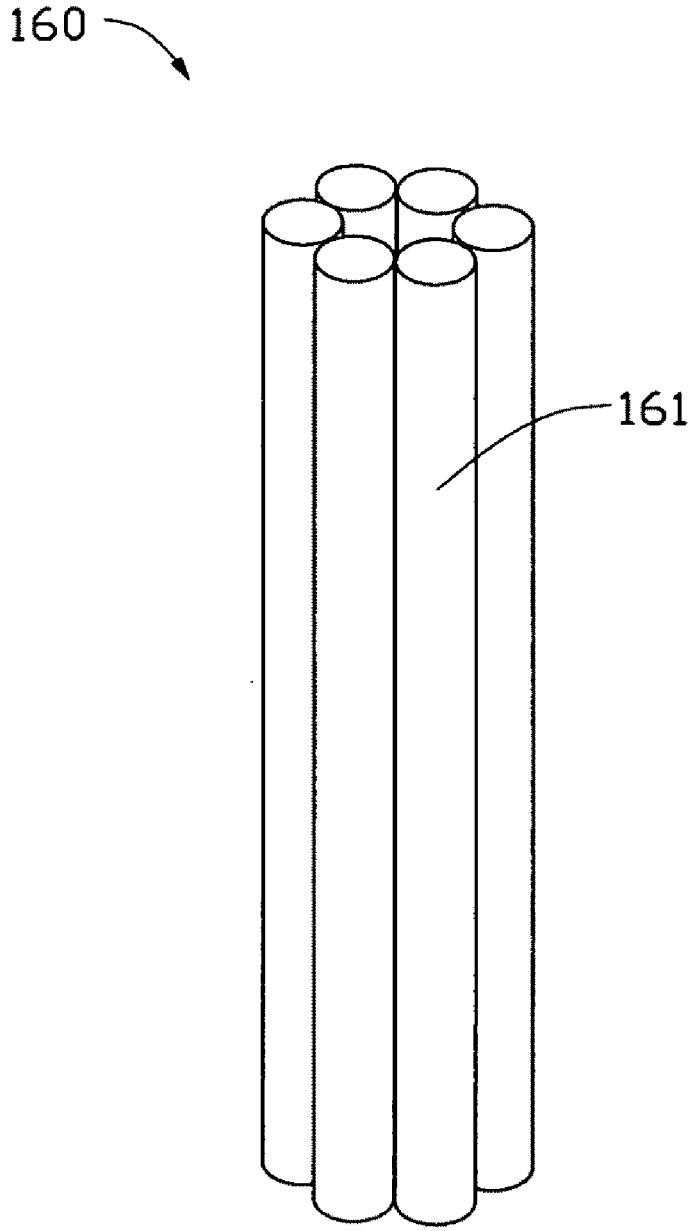
FIG. 3 is a schematic structural view of a bundle-like carbon nanotube wire-shaped structure.
Figure 4:
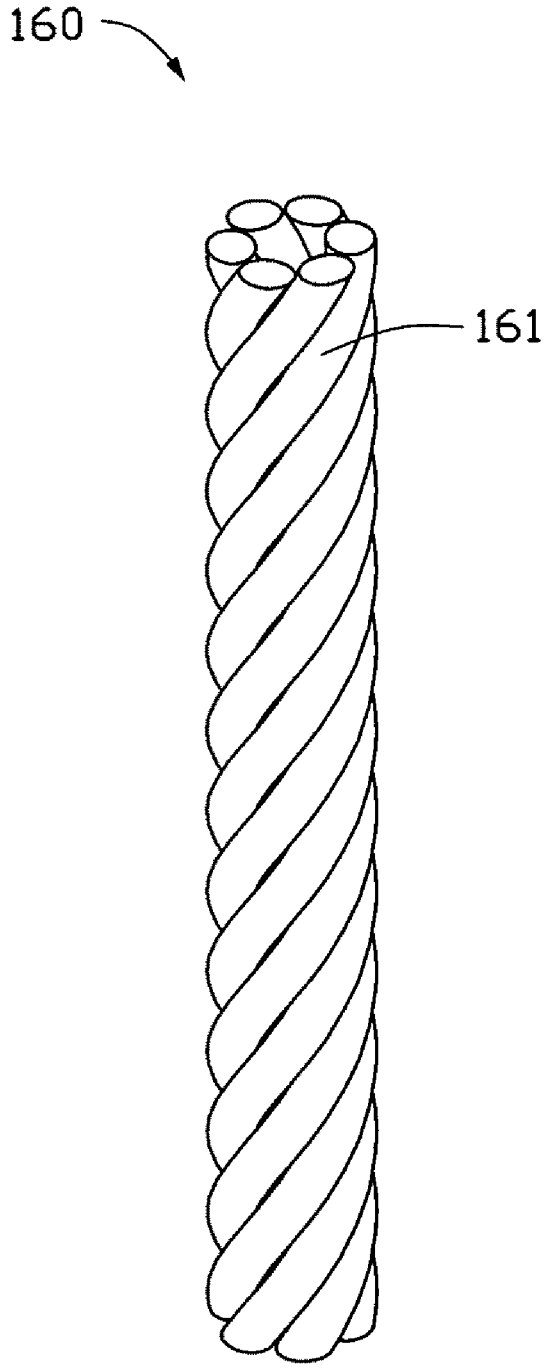
FIG. 4 is a schematic structural view of a twisted carbon nanotube wire-shaped structure.

Because the carbon nanotube wire-shaped structure 160 has a large specific surface area and the carbon nanotubes therein have a small heat capacity, the carbon nanotube wire-shaped structure 160 can have a small heat capacity per unit area. The heat capacity per unit area of the carbon nanotube wire-shaped structure 160 can be less than $2\times10^{-4}$ J/cm$^2$·K. In one embodiment, the heat capacity per unit area of the carbon nanotube wire-shaped structure 160 is less than $5\times10^{-5}$ J/cm$^2$·K. The carbon nanotube wire-shaped structure 160 can include at least one carbon nanotube wire. The carbon nanotube wire can be twisted or untwisted. The carbon nanotube wire includes a plurality of carbon nanotubes. The carbon nanotube wire-shaped structure 160 can include twisted carbon nanotube wires, untwisted carbon nanotube wires, or combinations thereof Referring to FIGS. 3-4, the carbon nanotube wires 161 in the carbon nanotube wire-shaped structure 160 can be substantially parallel to each other to form a bundle like structure or twisted with each other to form a twisted structure. The carbon nanotubes in the carbon nanotube wire 161 can be selected from single-walled, double-walled, and/or multi-walled carbon nanotubes. Diameters of the single-walled carbon nanotubes range from about 0.5 nanometers to about 50 nanometers. Diameters of the double-walled carbon nanotubes range from about 1 nanometer to about 50 nanometers. Diameters of the multi-walled carbon nanotubes range from about 1.5 nanometers to about 50 nanometers.

Figure 5:
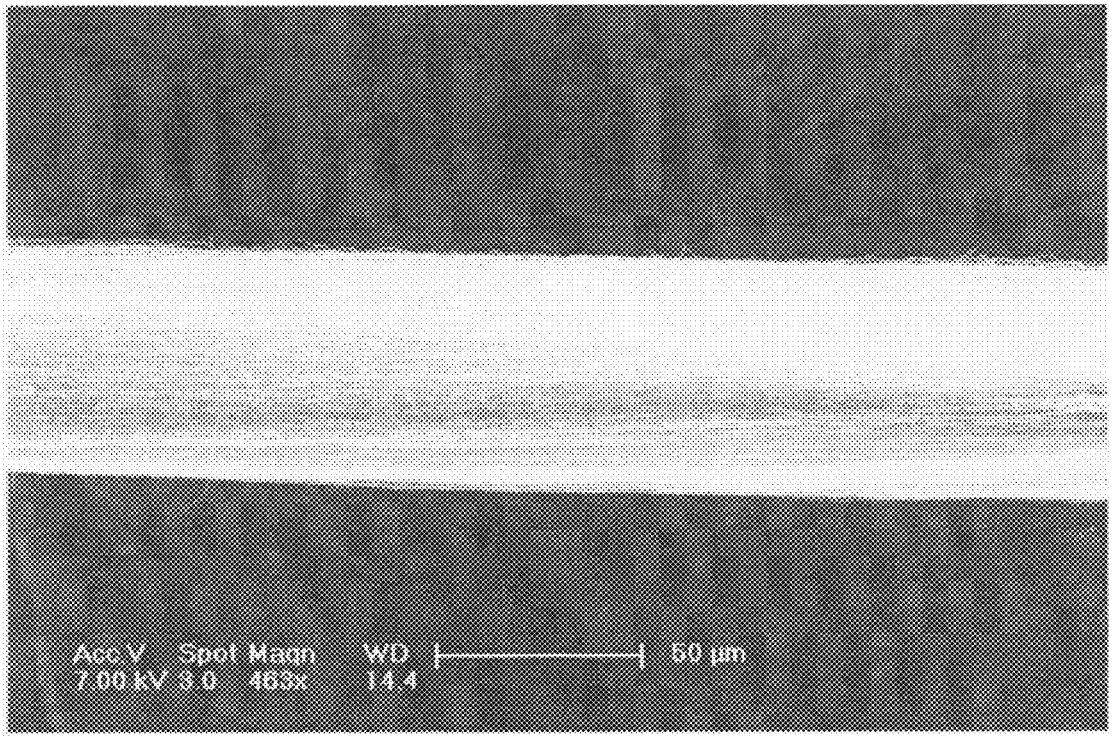
FIG. 5 is an Scanning Electron Microscope (SEM) image of a bundle-like carbon nanotube yarn.

The untwisted carbon nanotube wire can be formed by treating a drawn carbon nanotube film with a volatile organic solvent. The drawn carbon nanotube film includes a plurality of successive and oriented carbon nanotubes joined end-to-end by van der Waals attractive force therebetween. The carbon nanotubes in the drawn carbon nanotube film can be substantially aligned along a single direction. The drawn carbon nanotube film can be formed by drawing a film from a carbon nanotube array that is capable of having a film drawn therefrom. Specifically, the drawn carbon nanotube film is treated by applying the organic solvent to the drawn carbon nanotube film to soak the entire surface of the drawn carbon nanotube film. After being soaked by the organic solvent, the adjacent parallel carbon nanotubes in the drawn carbon nanotube film will bundle together when the organic solvent volatilizes, due to the surface tension of the organic solvent, and thus, the drawn carbon nanotube film will be shrunk into untwisted carbon nanotube wire. Referring to FIG. 5, the untwisted carbon nanotube wire includes a plurality of carbon nanotubes substantially oriented along a same direction (e.g., a direction along the length of the untwisted carbon nanotube wire). The carbon nanotubes are substantially parallel to an axis or the length of the untwisted carbon nanotube wire. A length of the untwisted carbon nanotube wire can be set as desired. The diameter of the untwisted carbon nanotube wire can range from about 0.5 nanometers to about 100 micrometers. In one embodiment, the diameter of the untwisted carbon nanotube wire is about 50 micrometers. Examples of a untwisted carbon nanotube wire is taught by US Patent Application Publication US 2007/0166223 to Jiang et al.

Figure 6:
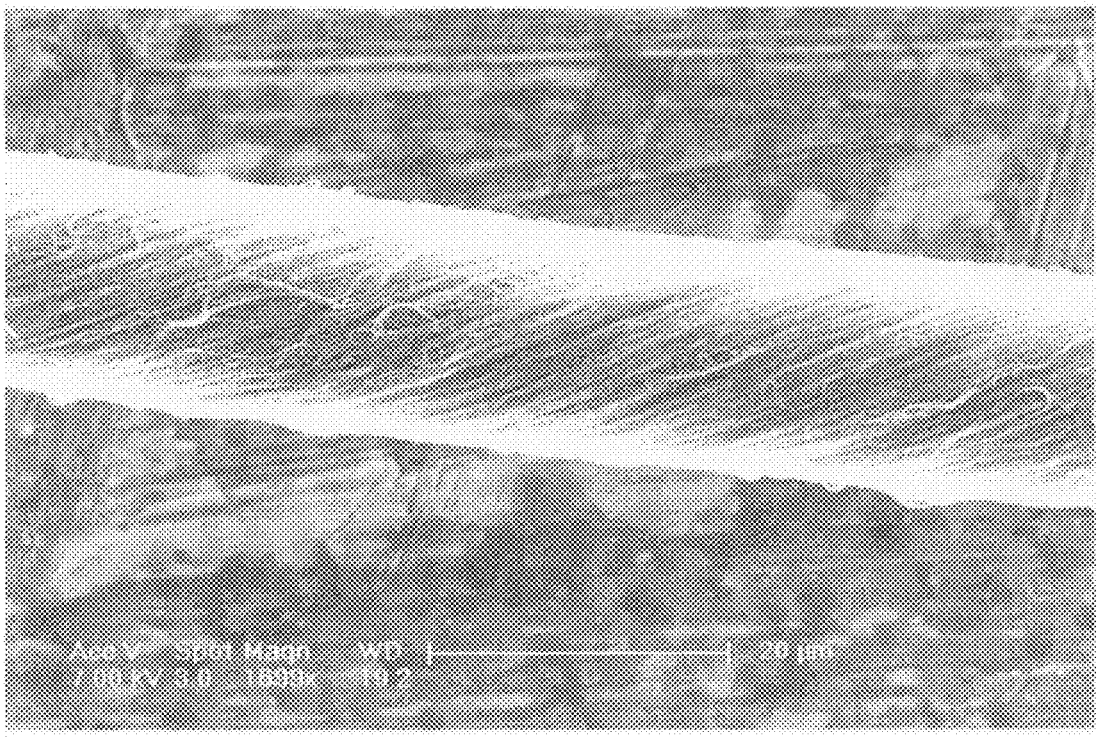
FIG. 6 is an SEM image of a twisted carbon nanotube yarn.

The twisted carbon nanotube wire can be formed by twisting the drawn carbon nanotube film by using a mechanical force to turn the two ends of the drawn carbon nanotube film in opposite directions. Referring to FIG. 6, the twisted carbon nanotube wire includes a plurality of carbon nanotubes oriented around an axial direction of the twisted carbon nanotube wire. The carbon nanotubes are aligned around an axis of the carbon nanotube twisted wire like a helix. A length of the carbon nanotube wire can be set as desired. The diameter of the twisted carbon nanotube wire can range from about 0.5 nanometers to about 100 micrometers. The twisted carbon nanotube wire can be treated with a volatile organic solvent, before or after being twisted. After being soaked by the organic solvent, the adjacent parallel carbon nanotubes in the twisted carbon nanotube wire will bundle together when the organic solvent volatilizes, due to the surface tension of the organic solvent. The specific surface area of the twisted carbon nanotube wire will decrease. The density and strength of the twisted carbon nanotube wire will be increased.

Further, the carbon nanotube wire-shaped structure 160 can include at least one carbon nanotube composite wire including at least one carbon nanotube wire 161 and other materials, such as metal, polymer, and other non-metallic materials. Since the carbon nanotubes have excellent heat resistance, the carbon nanotube composite wire including the carbon nanotubes composited with the polymer has a good flame-retardant property, and is conducive to increasing the flame-retardant property of the carbon nanotube fabric 10.

The thread 162 can be made of one of cotton, hemp, nylon, spandex, polyester, polyacrylonitrile, wool, silk, carbon fiber, and so on. A diameter of the thread 162 can be varied. In one embodiment, the thread 162 is generally as wide as the carbon nanotube wire-shaped structure 160. The thread 162 also has a heat resistance property to a certain extent and can be selected according to specific applications. In one embodiment, the thread 162 is made of cotton.

The first electrode 12 and the second electrode 14 are made of conductive material. The structure of the first electrode 12 or the second electrode 14 is not limited and can be lamellar, wire, block or other structure. A material of the first electrode 12 or the second electrode 14 can be chosen from a group that includes metal, alloy, indium tin oxide (ITO), antimony tin oxide (ATO), conductive silver glue, conductive polymer, conductive carbon nanotubes, and so on. A material of the metal or alloy includes aluminum, copper, tungsten, molybdenum, gold, titanium, neodymium, palladium, cesium, silver, or any combination thereof. In one embodiment, the first electrode 12 and the second electrode 14 are conductive wires. A diameter of the conductive wires is in a range from about 0.5 nanometers to about 100 micrometers. In another embodiment, the first electrode 12 and the second electrode 14 are silver wires. The silver wires can be woven or sewn in the heating element 16 and electrically connected to the carbon nanotube wire-shaped structure 160.

The first electrode 12 and the second electrode 14 are separately located to avoid short-circuiting. The location of the first electrode 12 and the second electrode 14 is related to the arranged direction of the carbon nanotube wire-shaped structure 160. Two ends of at least part of the carbon nanotube wire-shaped structure 160 can be electrically connected to the first electrode 12 and the second electrode 14. In one embodiment, the carbon nanotube wire-shaped structures 160 are arranged primarily along a direction extending from the first electrode 12 to the second electrode 14.

In other embodiments, a conductive adhesive layer (not shown) can be further provided between the first electrode 12 or the second electrode 14 and the heating element 16. The conductive adhesive layer can be applied to the surface of the heating element 16. The conductive adhesive layer can be used to provide electrical contact and more adhesion between the electrodes 12, 14 and the heating element 16. In one embodiment, the conductive adhesive layer is a layer of silver paste.

In use, when a voltage is applied to the first electrode 12 and the second electrode 14, the carbon nanotube structure of the heating element 16 radiates heat at a certain electromagnetic wavelength. An object to be heated or warmed can be directly attached on or positioned near the carbon nanotube fabric 10. The carbon nanotube fabric 10 can have a free-standing structure when the object to be heated is not in contact with the carbon nanotube fabric 10.

By controlling the specific surface area of the heating element 16, varying the voltage, and controlling the density and diameter of the carbon nanotube wire-shaped structures in the heating element 16, the heating element 16 can be made to emit heat at different wavelengths. At a certain voltage, the wavelength of the electromagnetic waves emitted from the heating element 16 is inversely proportional to the density and diameter of the carbon nanotube wire-shaped structure in the heating element 16. The greater the density and diameter of the carbon nanotube wire-shaped structure in the heating element 16, the shorter the wavelength of the electromagnetic waves. The wavelength of the electromagnetic waves can be in the visible light region. The lower the density and diameter of the carbon nanotube wire-shaped structure in the heating element 16, the longer the wavelength of the electromagnetic waves. The wavelength of the electromagnetic waves can be in the infrared region. At a certain density and diameter of the carbon nanotube wire-shaped structure in the heating element 16, the wavelength of the electromagnetic waves emitted from the carbon nanotube fabric 10 is inversely proportional to the voltage applied. That is to say, when the density and diameter of the carbon nanotube wire-shaped structure in the heating element 16 is fixed, the greater the voltage applied, the shorter the wavelength of the electromagnetic waves, such as in the visible light region. Accordingly, the lower the voltage applied, the longer the wavelength of the electromagnetic waves, such as in the infrared region.

The heating element 16 has excellent electrical conductivity, thermal stability, and high thermal radiation efficiency, because the carbon nanotubes have an ideal black body structure. Thus, the carbon nanotube fabric 10 can be safely exposed, while working, to oxidize gases in a typical environment or atmospheric environment. When the diameter of the carbon nanotube wire-shaped structure is 5 millimeters and a voltage ranging from about 10 volts to about 30 volts is applied, the heating element 16 can radiate electromagnetic waves with a long wavelength. The temperature of the carbon nanotube fabric 10 can range from about 50° C. to about 500° C. As an ideal black body structure, the carbon nanotube wire-shaped structure in the heating element 16 can radiate heat when it reaches a temperature of about 200° C. to about 450° C. The radiating efficiency is relatively high.

Figure 14:
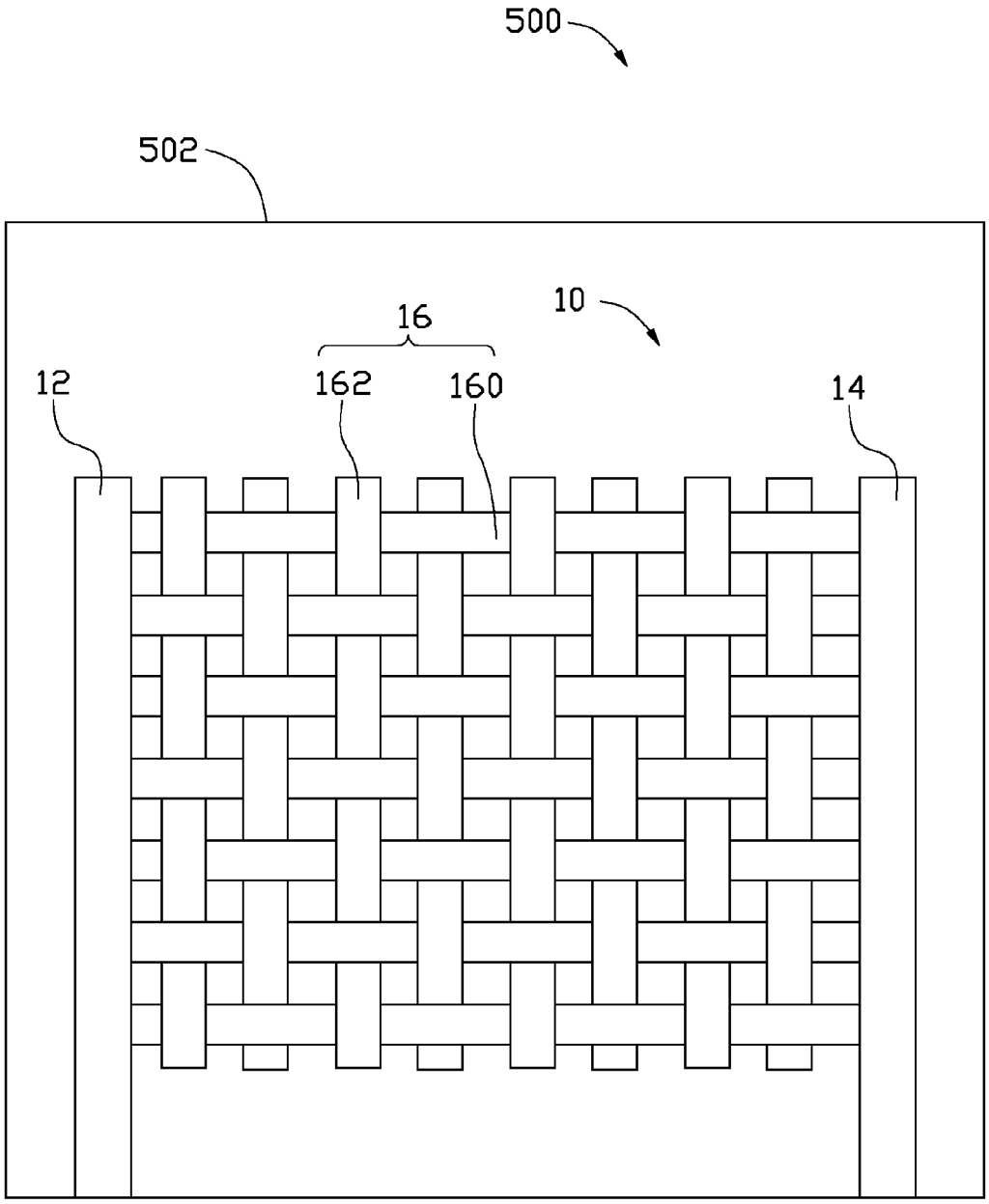
FIG. 14 is a schematic view of one embodiment of a heater made of the carbon nanotube fabric.

The carbon nanotube fabric 10 can be located in a vacuum device 502 or a device 502 filled with inert gas to form a heater 500 as shown in FIG. 14. When the voltage is increased to a range from about 80 volts to about 150 volts, the carbon nanotube fabric 10 emits electromagnetic waves having a relatively short wave length such as visible light (e.g. red light, yellow light etc), general thermal radiation, and ultraviolet radiation. The temperature of the carbon nanotube fabric 10 can reach about 1500° C. When the voltage on the carbon nanotube fabric 10 is high enough, the carbon nanotube fabric 10 can radiate ultraviolet light sufficient to kill bacteria. Since the carbon nanotube wire-shaped structure 160 has a good electromagnetic shielding property, the carbon nanotube fabric 10 adopting the carbon nanotube wire-shaped structure 160 has a good electromagnetic shielding property, and thus, the carbon nanotube fabric 10 can be used in radiation fields, such as in radiation proof clothes.

Figure 7:
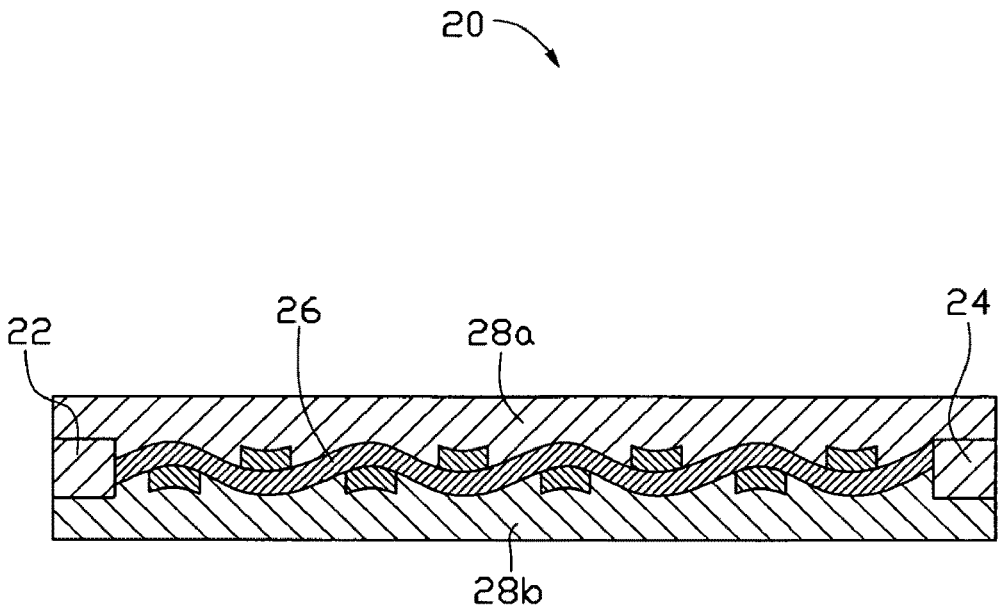
FIG. 7 is a schematic view of one embodiment of a carbon nanotube fabric, the carbon nanotube fabric including a heating element.

Referring to FIG. 7, the carbon nanotube fabric 20 according to one embodiment includes a heating element 26, a first electrode 22, a second electrode 24, a first fabric layer 28*a*, and a second fabric layer 28*b*. The heating element 26 is located between the first fabric layer 28*a* and the second fabric layer 28*b*. The heating element 26 can be woven from the carbon nanotube wire-shaped structure (not shown) and the thread (not shown), or include at least one carbon nanotube film. The first electrode 22 and the second electrode 24 are electrically connected to the carbon nanotube wire-shaped structure or the at least one carbon nanotube film.

The carbon nanotube fabric 20 in the embodiment shown in FIG. 7 is similar to the carbon nanotube fabric 10 in the embodiment shown in FIG. 1. The difference is that the heating element 26 can include at least one carbon nanotube film, and the carbon nanotube fabric 20 can further include the first fabric layer 28*a* and the second fabric layer 28*b*. The first fabric layer 28*a* and the second fabric layer 28*b* play a role of protecting the heating element 26.

Figure 8:
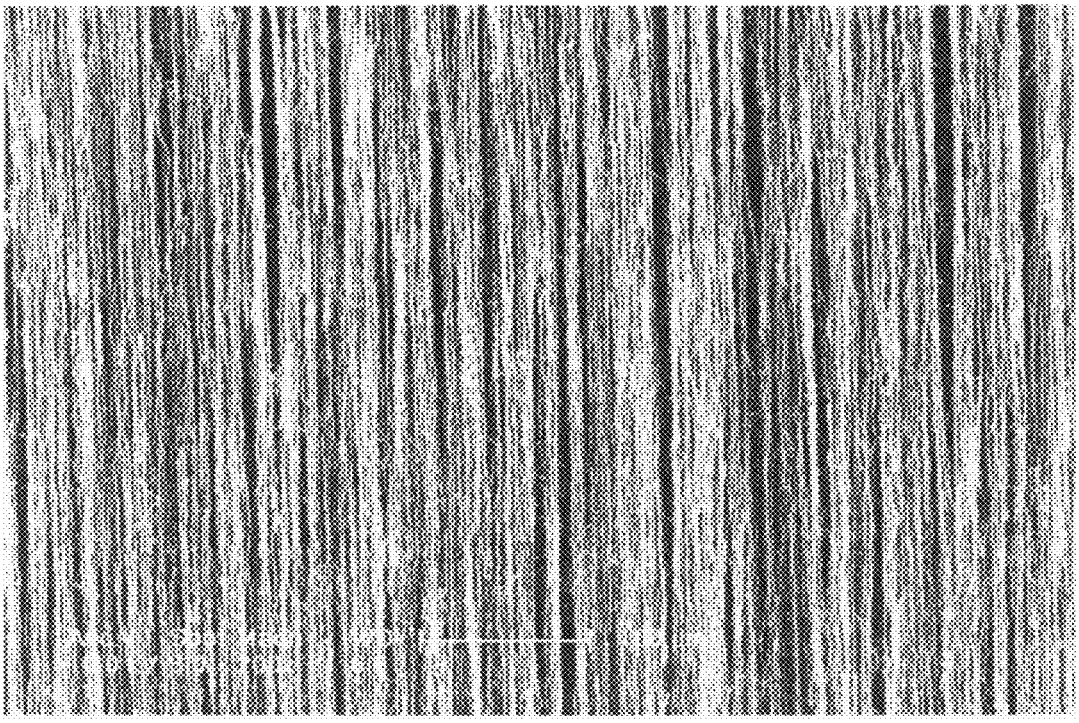
FIG. 8 is an SEM image of a carbon nanotube film that can be utilized as the heating element of FIG. 7.
Figure 9:
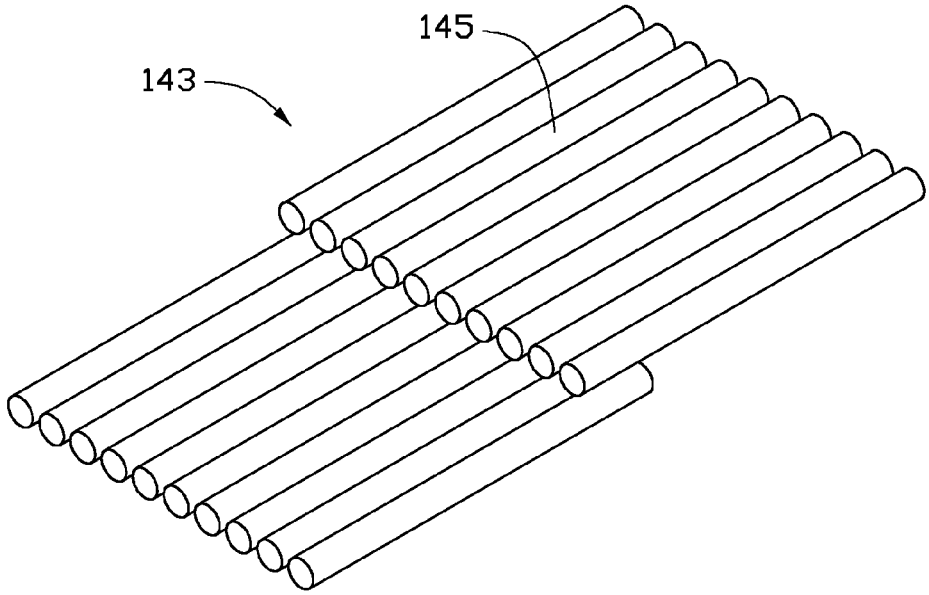
FIG. 9 is a schematic structural view of a carbon nanotube segment.

The carbon nanotube film can be a drawn carbon nanotube film. The drawn carbon nanotube film includes a plurality of successive and oriented carbon nanotubes joined end-to-end by van der Waals attractive force therebetween. The carbon nanotubes in the drawn carbon nanotube film can be substantially aligned in a single direction. The drawn carbon nanotube film can be formed by drawing a film from a carbon nanotube array that is capable of having a film drawn therefrom. Examples of a drawn carbon nanotube film is taught by U.S. Pat. No. 7,045,108 to Jiang et al., and US patent application US 2008/0170982 to Zhang et al. Referring to FIGS. 8 to 9, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 substantially parallel to each other, and combined by van der Waals attractive force therebetween. As can be seen in FIG. 8, some variations can occur in the drawn carbon nanotube film. The carbon nanotubes 145 in the drawn carbon nanotube film are also oriented substantially along a preferred orientation. The carbon nanotube film can also be treated with an organic solvent. After that, the mechanical strength and toughness of the treated carbon nanotube film are increased and the coefficient of friction of the treated carbon nanotube films is reduced. The thickness of the carbon nanotube film can range from about 0.5 nanometers to about 100 micrometers.

The heating element 26 also can include at least two stacked carbon nanotube films. In other embodiments, the heating element 26 can include two or more coplanar carbon nanotube films. These coplanar carbon nanotube films can be stacked one upon another. Additionally, an angle can exist between the orientation of carbon nanotubes in adjacent films. Adjacent carbon nanotube films can be combined only by the van der Waals attractive force therebetween. The number of the layers of the carbon nanotube films is not limited. An angle between the aligned directions of the carbon nanotubes in the two adjacent carbon nanotube films can range from about 0° to about 90°. When the angle between the aligned directions of the carbon nanotubes in adjacent carbon nanotube films is larger than 0 degrees, a microporous structure is defined by the carbon nanotubes in the heating element 26. The heating element 26 in one embodiment employing these films will have a plurality of micropores. Stacking the carbon nanotube films will add to the structural integrity of the heating element 26. In some embodiments, the heating element 26 has a free standing structure and does not require the use of structural support.

The heating element 26 can be bonded or combined with the first fabric layer 28*a* and the second fabric layer 28*b* by using an adhesive or sewing them together. In one embodiment, waterproof adhesive can be used, thereby allowing washing of the carbon nanotube fabric 20 without degrading the bond.

The material of the first fabric layer 28*a* and the second fabric layer 28*b* can be chosen from a group that includes cotton, hemp, nylon, spandex, polyester, polyacrylonitrile (PAN), wool, carbon fiber, silk, and so on. The material of the first fabric layer 28*a* and the second fabric layer 28*b* can be the same as that of the thread 162 in the embodiment shown in FIG. 1. In one embodiment, the material of the first fabric layer 28*a* and the second fabric layer 28*b*, and the thread 162, is cotton.

An area of the heating element 26 can be smaller than that of the first fabric layer 28*a* and/or the second fabric layer 28*b*. Thus, the heating element 26 can be regionally located in the carbon nanotube fabric 20 according to specific applications. For example, when the carbon nanotube fabric 20 is applied to clothes, such as infrared physiotherapy trousers configured for knee therapy, the carbon nanotube fabric 20 can be located only where needed at a position corresponding to the knees.

A heater adopting the carbon nanotube fabric is further provided according to one embodiment. The heater includes a body, and a carbon nanotube fabric embedded in the body. The body further includes two surface layers and the carbon nanotube fabric located between the two surface layers. The carbon nanotube fabric and the two surface layers can be sewn together or bonded together with an adhesive. A material of the two surface layers includes fabric and other materials. The material of the two surface layers can be the same as that of the first fabric layer 28*a* and the second fabric layer 28*b*. It can be understood that when the carbon nanotube fabric 20 is adopted, the two surface layers are optional. The structure of the heater is not limited. The body can be an insole, a hat, a blanket, a physiotherapy instrument, or other objects where a heating function is desired.

Figure 10:
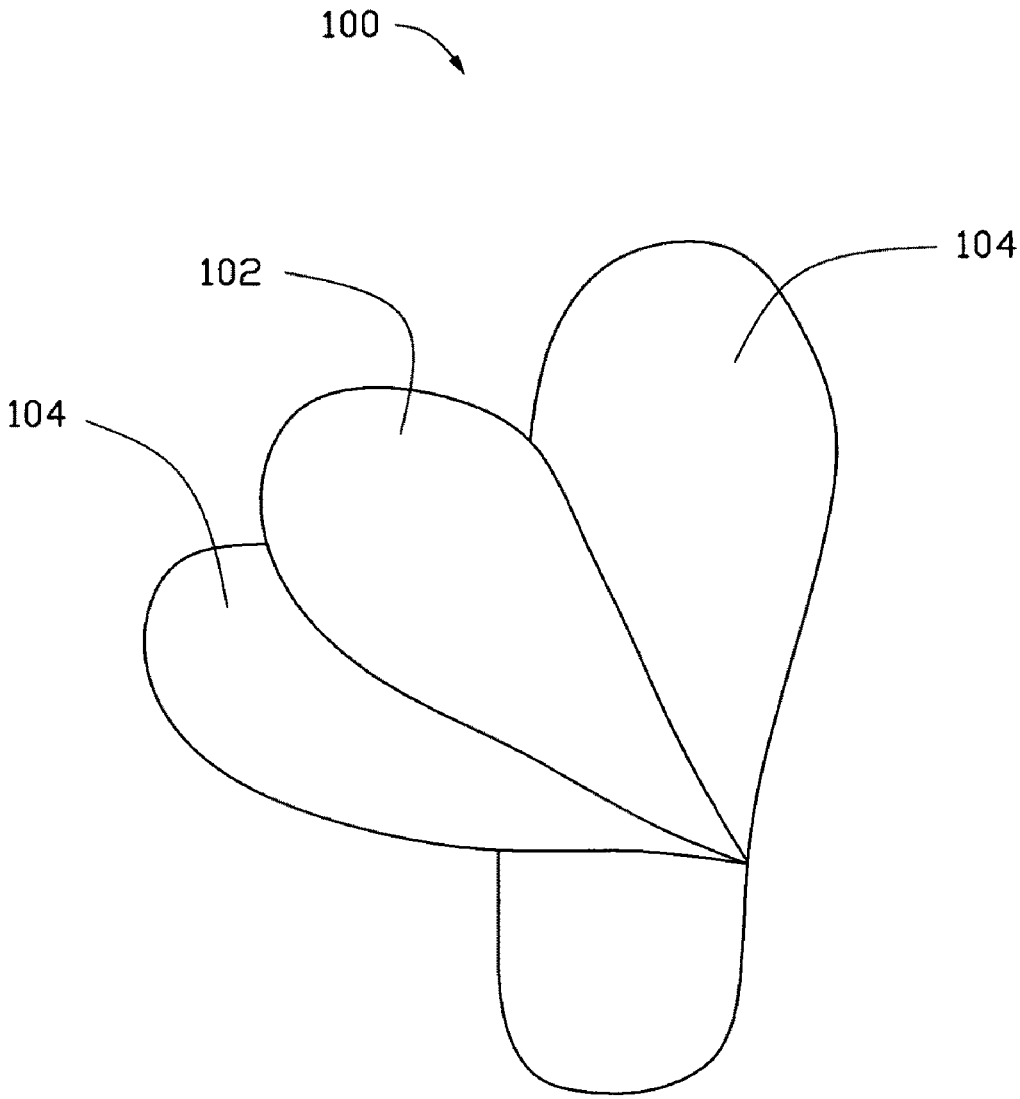
FIG. 10 is a schematic view of one embodiment of an insole made of the carbon nanotube fabric.

Referring to FIG. 10, the body is an insole 100 that might be used in a shoe design, for example, to heat a foot or part of a foot. A carbon nanotube fabric 102 having an insole like shape is embedded in the insole 100. The insole 100 further includes two surface layers 104 corresponding to the shape of the carbon nanotube fabric 102, e.g., an insole like shape having a same size with that of the carbon nanotube fabric 102. The carbon nanotube fabric 102 is located between the two surface layers 104. The carbon nanotube fabric 102 and the two surface layers 104 can be bonded together or sewn. The carbon nanotube fabric 102 can include the carbon nanotube fabric 10 of FIG. 1 and the carbon nanotube fabric 20 of FIG. 7. The carbon nanotube fabric 102 can be fabricated by cutting or tailoring the carbon nanotube fabric 10 and the carbon nanotube fabric 20 into the shape of an insole. The two surface layers 104 can be made of fabric, preferably a fabric comfortable to the touch. It can be understood that when the carbon nanotube fabric 102 is the carbon nanotube fabric 20, the two surface layers 104 are optional.

The carbon nanotubes have a good adsorption capacity due to the 'carbon nanotubes' large specific surface area. The carbon nanotube fabric 102 including the carbon nanotubes can have a deodorizing effect. Further, hydrophilic groups, or hydrophilic lipophilic groups, such as polyvinyl pyrrolidone (PVP) can be introduced into the carbon nanotubes, so that the carbon nanotube fabric 102 has a sweat-absorbent function, and thus the insole 100 with the deodorant and the sweat-absorbent dual functions can be prepared.

Further, a voltage can be applied to the carbon nanotube fabric 102 to make the carbon nanotube fabric 102 radiate electromagnetic waves, thereby drying the insole 100. Thus, the insole 100 can be worn in long-term wet environment. The carbon nanotube fabric 102 also can be located regionally in the insole 100, such as an acupressure point. The carbon nanotube fabric 102 can be located at an acupressure point used to prevent or treat hyperthermia, for example.

Figure 11:
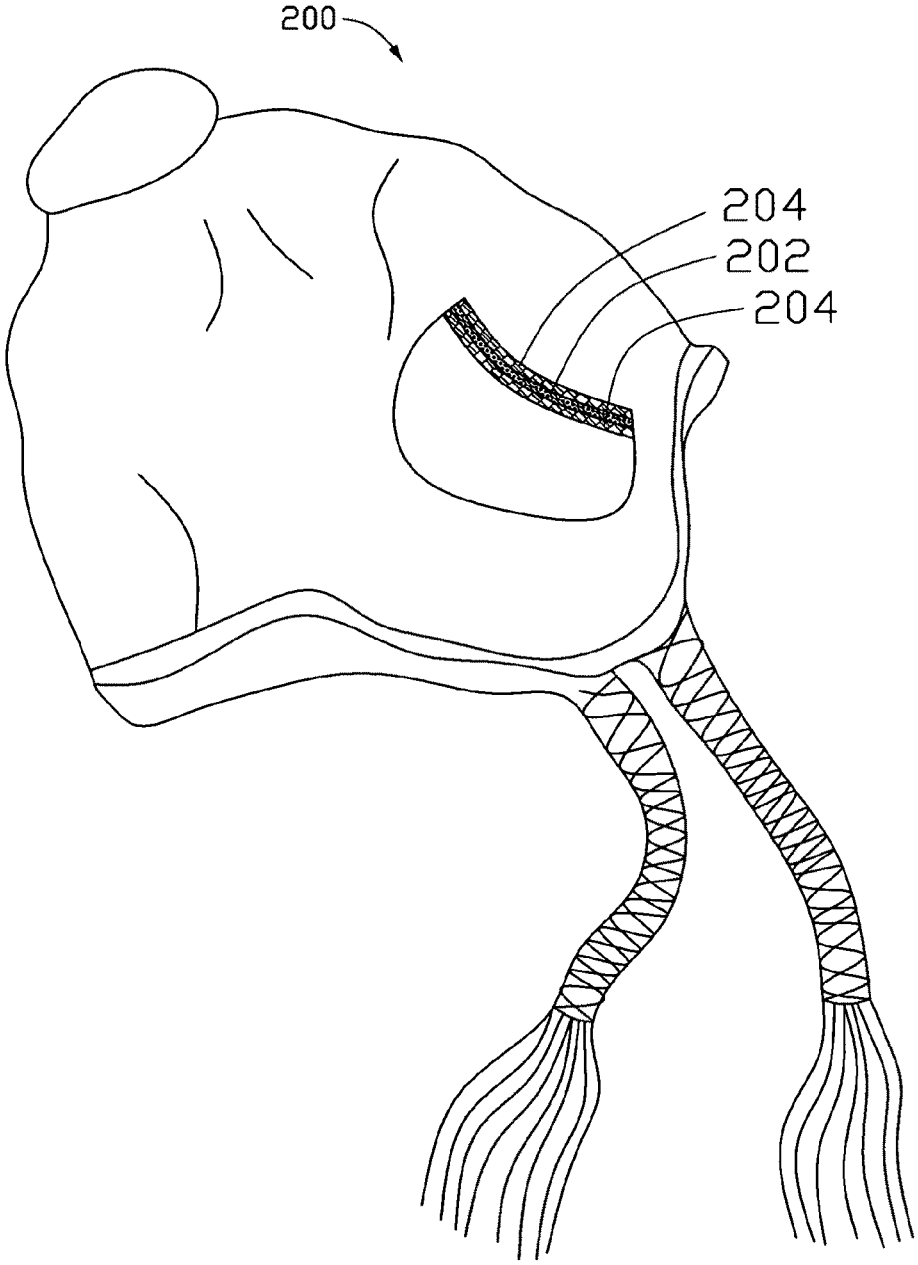
FIG. 11 is a schematic view of one embodiment of a hat made of the carbon nanotube fabric.

Referring to FIG. 11, the body can be a hat 200. A carbon nanotube fabric 202 having a hat like shape is embedded in the hat 200. The hat 200 further includes two surface layers 204 having a shape corresponding to the carbon nanotube fabric 202, e.g., a hat like shape having a same size with that of the carbon nanotube fabric 202. The carbon nanotube fabric 202 can be fabricated by cutting the carbon nanotube fabric 10 of FIG. 1 and the carbon nanotube fabric 20 of FIG. 7 into the shape of a hat.

Composition and structure of the hat 200 are the same with that of the insole 100. The carbon nanotube fabric 202 also can be located regionally in the hat 200, such as at a location corresponding to the ear. The density of the carbon nanotubes in the carbon nanotube fabric 202 can be regulated to realize regional temperature control at different positions.

Figure 12:
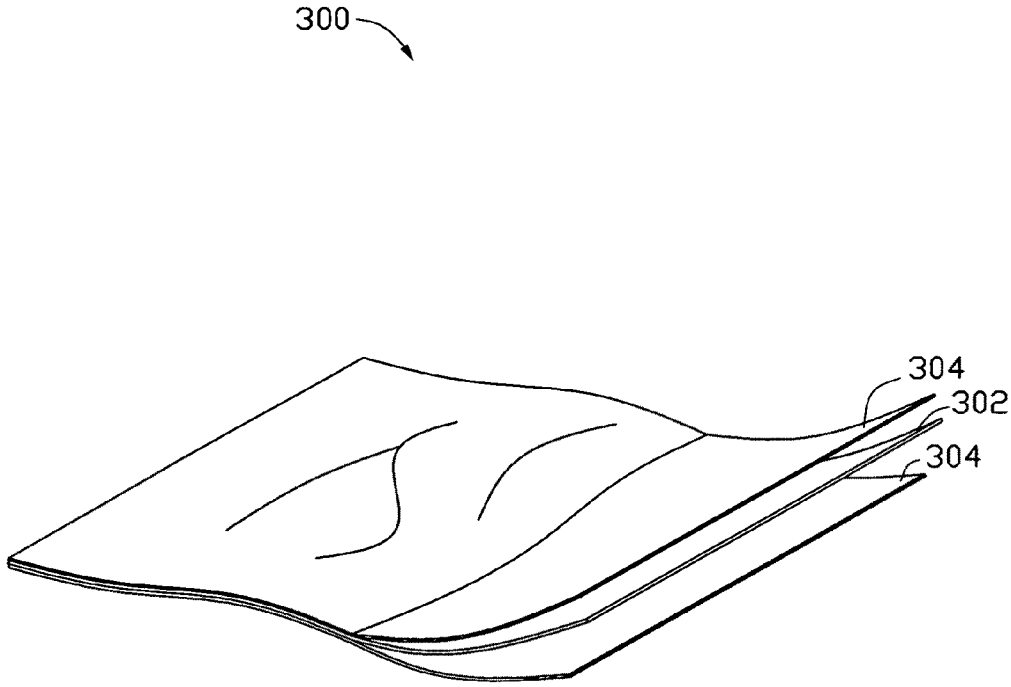
FIG. 12 is a schematic view of one embodiment of an electric blanket made of the carbon nanotube fabric.

Referring to FIG. 12, the body can be a blanket 300. A carbon nanotube fabric 302 having a blanket like shape is embedded in the blanket 300. The blanket 300 further includes two surface layers 304 having a shape corresponding to the carbon nanotube fabric 302. The blanket 300 can be fabricated by cutting the carbon nanotube fabric 10 of FIG. 1 and the carbon nanotube fabric 20 of FIG. 7 into the shape of a blanket. The carbon nanotube fabric 302 can cover entire area of the blanket 300.

Figure 13:
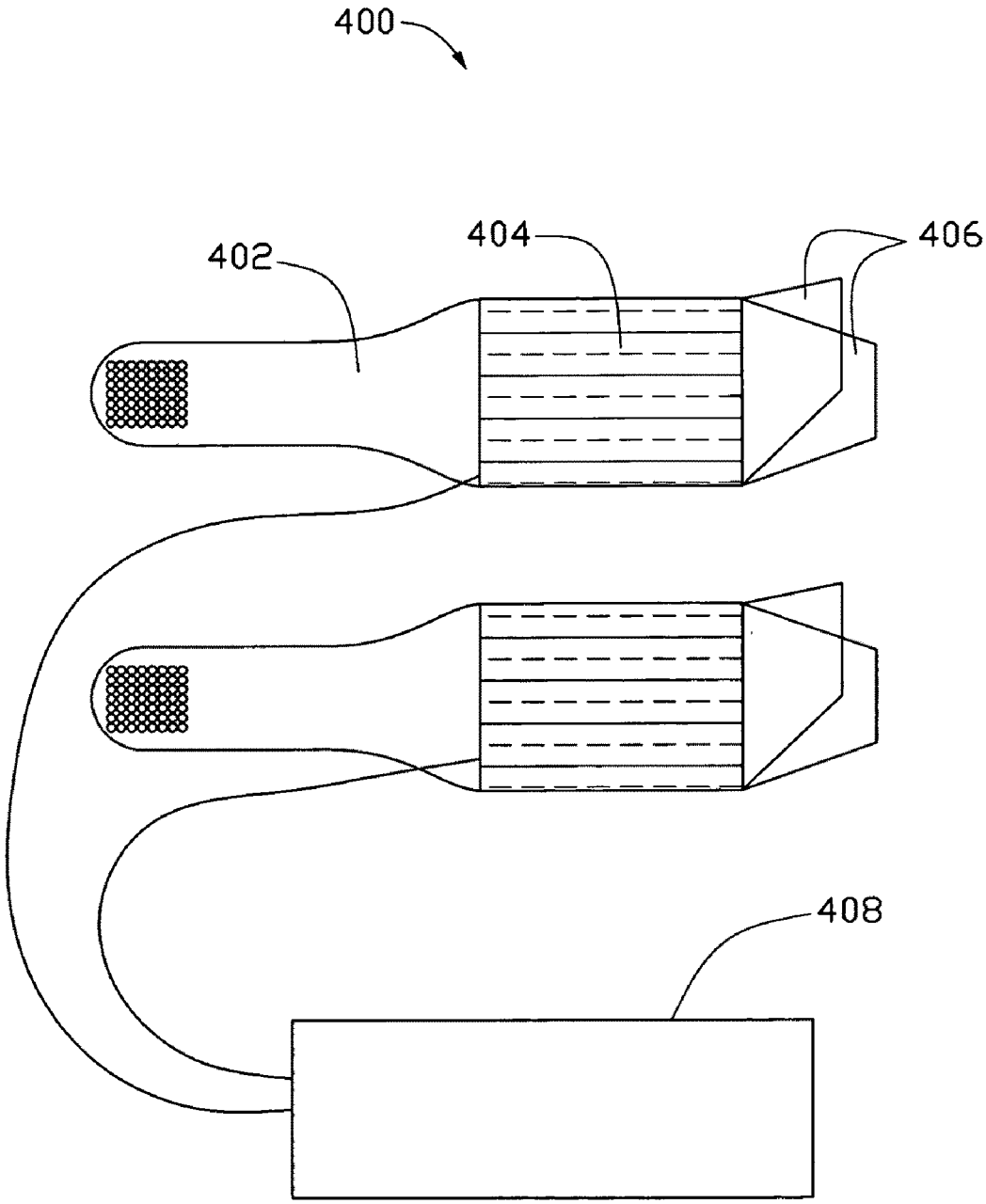
FIG. 13 is a schematic view of one embodiment of a physiotherapy instrument made of the carbon nanotube fabric.

Referring to FIG. 13, the body can be a physiotherapy instrument 400. The physiotherapy instrument 400 includes at least one physical therapy band 402. A carbon nanotube fabric 402 is embedded in each physical therapy band 402. The physical therapy band 402 further includes two surface layers 406. The carbon nanotube fabric 402 is located between the two surface layers 406. The carbon nanotube fabric 402 can include the carbon nanotube fabric 10 of FIG. 1 and the carbon nanotube fabric 20 of FIG. 7. The carbon nanotube fabric 404 can be located at a location desired for physical therapy. The carbon nanotube fabric 404 can cover the entire area of the physical therapy band 402 or just located regionally. For example, when the knee desires physical therapy, the carbon nanotube fabric 404 can be located at the knee.

In one embodiment, the physiotherapy instrument 400 includes two physical therapy bands 402. The carbon nanotube fabric 404 is regionally located in each of the physical therapy bands 402. In use, the two physical therapy bands 402 can be further electrically connected to a power supply 408. The physiotherapy instrument 400 also can include some auxiliary equipment to realize some auxiliary functions, such as overtime and over-temperature protection functions.

It can be understood that the carbon nanotube fabric 404 is not limited to the above described applications. The carbon nanotube fabric 404 also can be applied to other fields where fabrics are used, such as clothing, and other heating fields, such as the carbon nanotube fabric hung in a room to replace radiators in the winter.

The carbon nanotube fabric and the heater adopting the same have a plurality of merits including the following. Firstly, the properties of the carbon nanotubes provide superior toughness and high mechanical strength to the heating element. Thus, the carbon nanotube fabric 20 and the heater adopting the fabric 20 are durable. Secondly, since the carbon nanotubes are an ideal black body structure, the fabric 20 has good conductivity and thermal stability, and a relatively high efficiency of heat radiation. Thus, the heating element, adopting the carbon nanotubes joined end to end, has a high electric-thermal conversion efficiency. Thirdly, micro-fabrics and a micro-heater adopting the carbon nanotube wire like structure and the carbon nanotube film can be prepared because the carbon nanotubes have a small diameter, and the carbon nanotube wire-shaped structure and the carbon nanotube film can have a small thickness. Finally, the carbon nanotube wire like structure and the carbon nanotube film can be located regionally in the heating element, thus, the carbon nanotube fabric and the heater adopting the same can have a wide range of applications, and conducive to reduce cost of the carbon nanotube fabric and the heater adopting the same.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A carbon nanotube fabric, comprising:

a heating element comprising a plurality of carbon nanotubes joined end to end; and at least two electrodes separately located and electrically connected to the carbon nanotubes of the heating element, wherein the at least two electrodes are made of conductive carbon nanotubes.

2. The carbon nanotube fabric of claim 1, wherein the carbon nanotubes are formed in at least one carbon nanotube wire-shaped structure or at least one carbon nanotube film.

3. The carbon nanotube fabric of claim 2, wherein the carbon nanotubes are formed in the at least one carbon nanotube wire-shaped structure; further comprising at least one thread interwoven with the at least one carbon nanotube wire-shaped structure.

4. The carbon nanotube fabric of claim 1, wherein the carbon nanotubes are arranged along a direction extending from one electrode to another electrode.

5. The carbon nanotube fabric of claim 1, further comprising a first fabric layer and a second fabric layer, the heating element being located between the first fabric layer and the second fabric layer.

6. The carbon nanotube fabric of claim 1, wherein the at least two electrodes are conductive wires weaved in the heating element.

7. The carbon nanotube fabric of claim 2, wherein the at least one carbon nanotube wire-shaped structure comprises at least one carbon nanotube wire.

8. The carbon nanotube fabric of claim 2, wherein the carbon nanotubes are formed in the at least one carbon nanotube film; the heating element comprises at least two carbon nanotube films stacked upon each other.

9. The carbon nanotube fabric of claim 3, wherein a material of the at least one thread is selected from the group consisting of cotton, hemp, nylon, spandex, polyester, polyacrylonitrile, wool, carbon fiber, and silk.

10. The carbon nanotube fabric of claim 3, wherein a heat capacity per unit area of the carbon nanotube wire-shaped structure is less than $2\times10^{-4}$ J/cm2·K.

11. The carbon nanotube fabric of claim 7, wherein the carbon nanotube wire-shaped structure comprises a plurality of carbon nanotube wires substantially parallel to each other to form a bundle-like structure or twisted with each other to form a twisted structure.

12. The carbon nanotube fabric of claim 11, wherein the carbon nanotube wires comprises a plurality of carbon nanotubes aligned around an axis of the carbon nanotube wires like a helix or arranged substantially parallel to an axis of the carbon nanotube wires.

13. The carbon nanotube fabric of claim 5, wherein the heating element is bonded to the first fabric layer and the second fabric layer by an adhesive or the first fabric layer and the second fabric layer are sewn together.

14. The carbon nanotube fabric of claim 5, wherein the area of the heating element is less than or equal to that of the first fabric layer or the second fabric layer.

15. A heater, comprising:

a body; and a carbon nanotube fabric embedded in the body, the carbon nanotube fabric comprising:

a heating element and at least two electrodes, the heating element comprising a plurality of carbon nanotubes joined end to end, the at least two electrodes being separately located and electrically connected to the carbon nanotubes of the heating element, wherein the at least two electrodes are made of conductive carbon nanotubes.

16. The heater of claim 15, wherein the body is an insole, a hat, a blanket, or a physiotherapy instrument.

17. The heater of claim 15, wherein the body comprises two surface layers, the carbon nanotube fabric is located between the two surface layers.

18. A heater, comprising:

a device, wherein the device comprises a container in a state of vacuum or filled with inert gas; and a carbon nanotube fabric located in the container, the carbon nanotube fabric comprising:

a heating element, the heating element comprising a plurality of carbon nanotubes joined end to end; and at least two electrodes, the at least two electrodes being separately located and electrically connected to the carbon nanotubes of the heating element.

19. The heater of claim 18, wherein the at least two electrodes are made of conductive carbon nanotubes.

* * * * *